US005699608A

United States Patent [19]

Nakamura

[11] Patent Number: 5,699,608

[45] Date of Patent: Dec. 23, 1997

[54] CONNECTOR HOLDING DEVICE

[75] Inventor: Tokuji Nakamura, Yokkaichi, Japan

[73] Assignee: Sumitomo Wiring Systems, Ltd., Mie, Japan

[21] Appl. No.: 606,403

[22] Filed: Feb. 23, 1996

[30] Foreign Application Priority Data

Feb. 27, 1995 [JP] Japan ..... 7-038666

[51] Int. Cl.[6] ..... H01R 43/20

[52] U.S. Cl. ..... 29/747; 29/33 M; 29/748; 29/760; 269/157

[58] Field of Search ..... 29/33 M, 747, 29/748, 759, 760, 837, 845; 269/903, 152, 157, 160, 50

[56] References Cited

U.S. PATENT DOCUMENTS

| | | | |
|---|---|---|---|
| 3,601,890 | 8/1971 | Pityo et al. | 29/748 X |
| 4,395,028 | 7/1983 | Kent | 269/157 X |
| 4,395,818 | 8/1983 | Jackson | 29/760 X |
| 4,837,926 | 6/1989 | Boutcher, Jr. | 29/747 |
| 4,864,718 | 9/1989 | Ricard | 29/747 X |
| 4,967,470 | 11/1990 | Folk | 29/748 X |
| 5,333,374 | 8/1994 | Pittau | 29/33 M X |
| 5,355,583 | 10/1994 | Osumi et al. | 29/33 M X |
| 5,457,875 | 10/1995 | Ohta et al. | 29/760 X |

FOREIGN PATENT DOCUMENTS

| | | | |
|---|---|---|---|
| 452771 | 10/1991 | European Pat. Off. | 29/748 |
| 6-52962 | 2/1994 | Japan | 29/748 |

OTHER PUBLICATIONS

European Search Report No. 96301263 and Annex completed Feb. 28, 1997.

*Primary Examiner*—Peter Vo

*Attorney, Agent, or Firm*—Beveridge, DeGrandi, Weilacher & Young L.L.P.

[57] ABSTRACT

A connector holding device (A) is provided which is adapted to hold a connector (C) having a terminal insertion opening formed on a rear face (40) thereof and a retainer attachment opening (45) formed on an upper or lower face thereof. The connector holding device includes a pivot member (20) having a distal end portion (**20*b*) which is to be engaged with the retainer attachment opening (45) with the connector C being held by a connector holding portion (14). The distal end portion (20*b*) is formed with an inclined face (22). With the connector (C) being set in position, the inclined face (22) is engaged with the retainer attachment opening (45) in such a manner that the engagement depth gradually becomes greater along a terminal insertion direction. Even if a terminal is liable to deviate outward and project from the retainer attachment opening (45) during the insertion of the terminal, the inclined face (22) corrects the terminal insertion direction, thereby allowing the terminal to be assuredly accommodated in a terminal chamber (42**). The connector holding device is inexpensive with a simple construction, and can be readily applied to an automated apparatus.

10 Claims, 5 Drawing Sheets

CONNECTOR HOLDING DEVICE

BACKGROUND OF THE INVENTION

1. Field of the Invention

The present invention relates to a connector holding device for holding a connector when a terminal is to be inserted into the connector and, more particularly, to a connector holding device for holding a connector having a terminal insertion opening formed on a rear end face thereof and a retainer attachment opening formed on an upper or lower face thereof for attachment of a retainer for preventing terminal withdrawal.

2. Description of Related Art

In general, a connector is attached to an end of a wire harness. The connector ensures and facilitates the connection of the wire harness with another wire harness or an electrical component. When the connector is to be attached to the end of the wire harness, a plurality of terminals are respectively crimped at ends of a plurality of leads included in the wire harness, and inserted into corresponding terminal chambers of the connector. Such a process is partially performed by an automated apparatus, in which a movable handle holds a predetermined portion of a terminal to convey the terminal to a corresponding terminal insertion opening, and forcibly inserts the terminal into a corresponding terminal chamber through the terminal insertion opening.

The connector may have a retainer for preventing the inserted terminal from being withdrawn therefrom. There are two types of retainers. One is to be attached onto a face formed with the terminal insertion opening (a rear end face of the connector), and the other is to be attached onto any of the other faces of the connector (e.g., the upper face of the connector). The retainer of the former type is received by a cut step portion formed on part of the periphery of the terminal insertion opening. The cut step portion produces a step on the ceiling of the terminal chamber of the connector having the retainer of this type. This makes it difficult to insert the terminal into the terminal chamber because the leading end of the terminal abuts against the step.

To cope with this problem, a terminal insertion method is proposed in Japanese Unexamined Patent Publication No. 6-52962(1994). In accordance with the terminal insertion method, a guide wall movable by means of an air cylinder is engaged with the cut step portion with the retainer being opened. The guide wall covers the cut step portion which interferes with the insertion of the terminal, and defines a rectangular opening smoothly extending to the terminal chamber without producing a step. This allows the terminal to be smoothly guided from the opening to the terminal chamber.

In the case of a connector of a type having a retainer attached thereto from the upper or lower side thereof, however, the aforesaid terminal insertion method cannot be employed. The connector of this type is formed with a retainer attachment opening for attachment of the retainer on the upper or lower face thereof. The retainer attachment opening communicates with the inside of a terminal chamber.

Where a terminal is inserted from a terminal insertion opening into the terminal chamber of the connector, the retainer attachment opening may interfere with the insertion of the terminal. More specifically, the leading end of the terminal is liable to project from the retainer attachment opening or to abut against the peripheral portion defining the retainer attachment opening. This may cause the deformation of the terminal, thereby preventing the terminal from being assuredly inserted into the terminal chamber.

SUMMARY OF THE INVENTION

In view of problems which may be caused when a terminal is inserted into a connector formed with a retainer attachment opening on an upper or lower face thereof, it is an object of the present invention to provide a connector holding device which ensures smooth insertion of the terminal into a terminal chamber of the connector.

The connector holding device according to the present invention includes terminal insertion guide means provided in association with a connector retention space.

Where the connector is formed with a retainer attachment opening for attachment of a retainer for preventing terminal withdrawal, a terminal inserted from a terminal insertion opening may advance in an incorrect insertion direction and project from the retainer attachment opening. In such a case, the terminal insertion guide means corrects the insertion direction to prevent the terminal from projecting from the opening, and guides the terminal to a predetermined direction.

In accordance with one preferred mode, the terminal insertion guide means includes a guide face. The guide face is a face inclined along the terminal insertion direction. Therefore, the inserted terminal is guided to the predetermined insertion direction by the inclined face.

In accordance with another preferred mode, the terminal insertion guide means includes connector positioning means. The positioning means allows the connector to be positioned in a predetermined position in the connector retention space. Since the positioning means is provided in the terminal insertion guide means, an engagement position of the terminal insertion guide means is not offset with respect to the connector positioned by the positioning means.

DETAILED DESCRIPTION OF THE PREFERRED EMBODIMENTS

The present invention will hereinafter be described in detail by way of an embodiment thereof depicted in the attached drawings.

Figure 1:
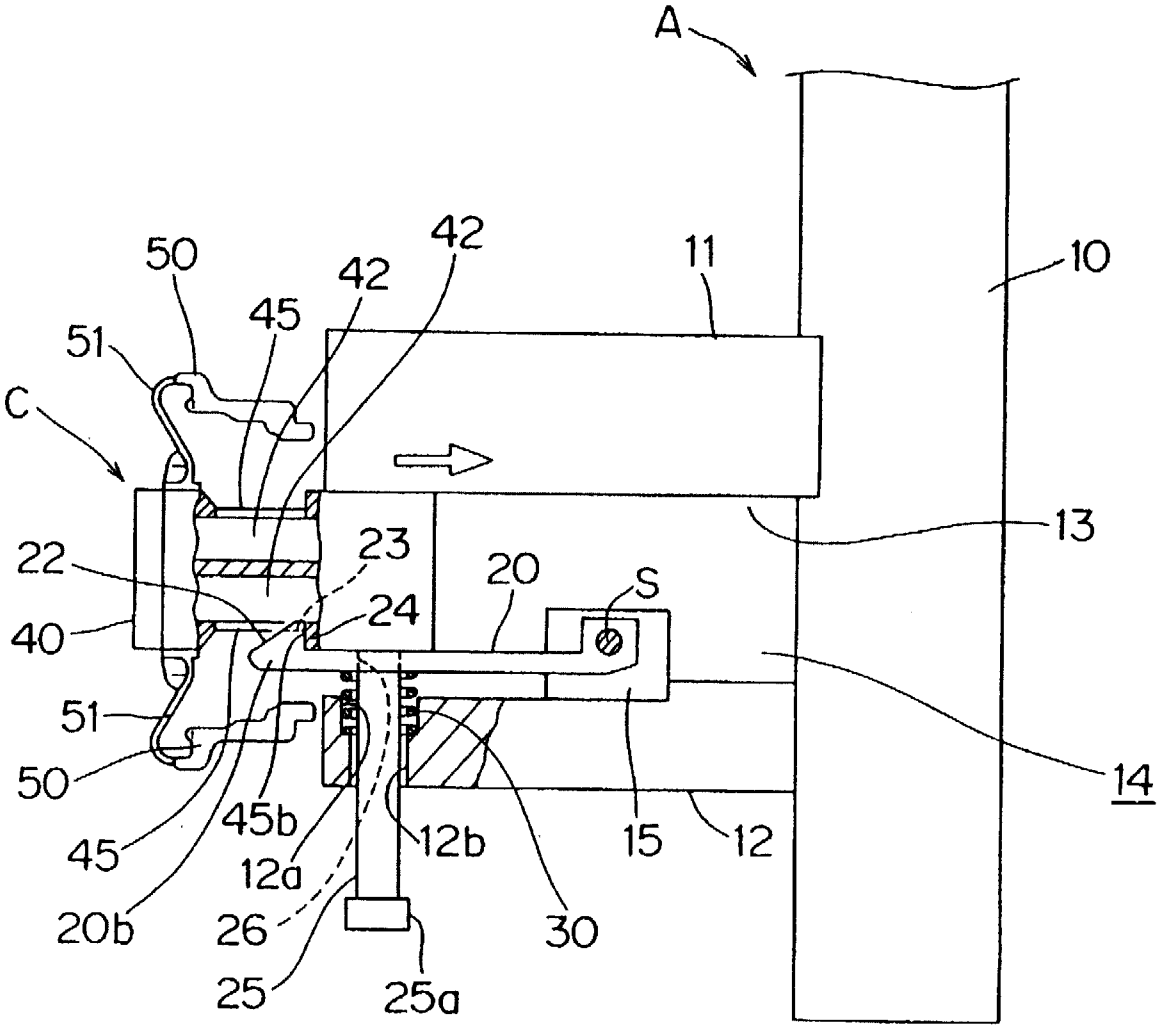
FIG. 1 is an enlarged partial side view in section illustrating a connector holding device in accordance with one embodiment of the present invention in a state where a connector is held thereby.

FIG. 1 is an enlarged partial side view in section illustrating a connector holding device in accordance with one embodiment of the present invention in a state where a connector is held thereby.

Referring to FIG. 1, the connector holding device A is adapted to hold a connector C of a particular type into which a terminal is to be inserted. The connector holding device A includes a base 10, upper and lower support members 11 and 12 projecting from the base 10, a pair of side support members 13 connecting side portions of the upper and lower support members 11 and 12, a pivot member 20 pivotally connected to the lower support member 12 and pivotal about a predetermined pivot center, and a coil spring 30 serving as a biasing member for constantly biasing the pivot member 20 toward the connector C.

The upper support member 11, the lower support member 12 and the side support members 13 cooperatively define a connector holding portion 14 for holding the connector C. The connector holding portion 14 is adapted to hold the connector C in such a manner that a rear end face (i.e., a face formed with terminal insertion openings 41) of the connector C is exposed (see FIG. 2). The lower support member 12 has a recess 12*a*formed in a predetermined position thereof and a through-hole 12*b*formed coaxially with the recess 12*a*and communicating with the recess 12*a*.

Although only one connector holding portion 14 constituted by the upper support member 11, the lower support member 12 and the side support members 13 is shown in FIG. 1 which illustrates a section of the connector holding device A, a plurality of connector holding portions each comprised of an upper support member 11, lower support member 12 and side support members 13 are aligned perpendicular to the plane of the drawing. Therefore, the connector holding device A can hold a plurality of connectors C.

Figure 2:
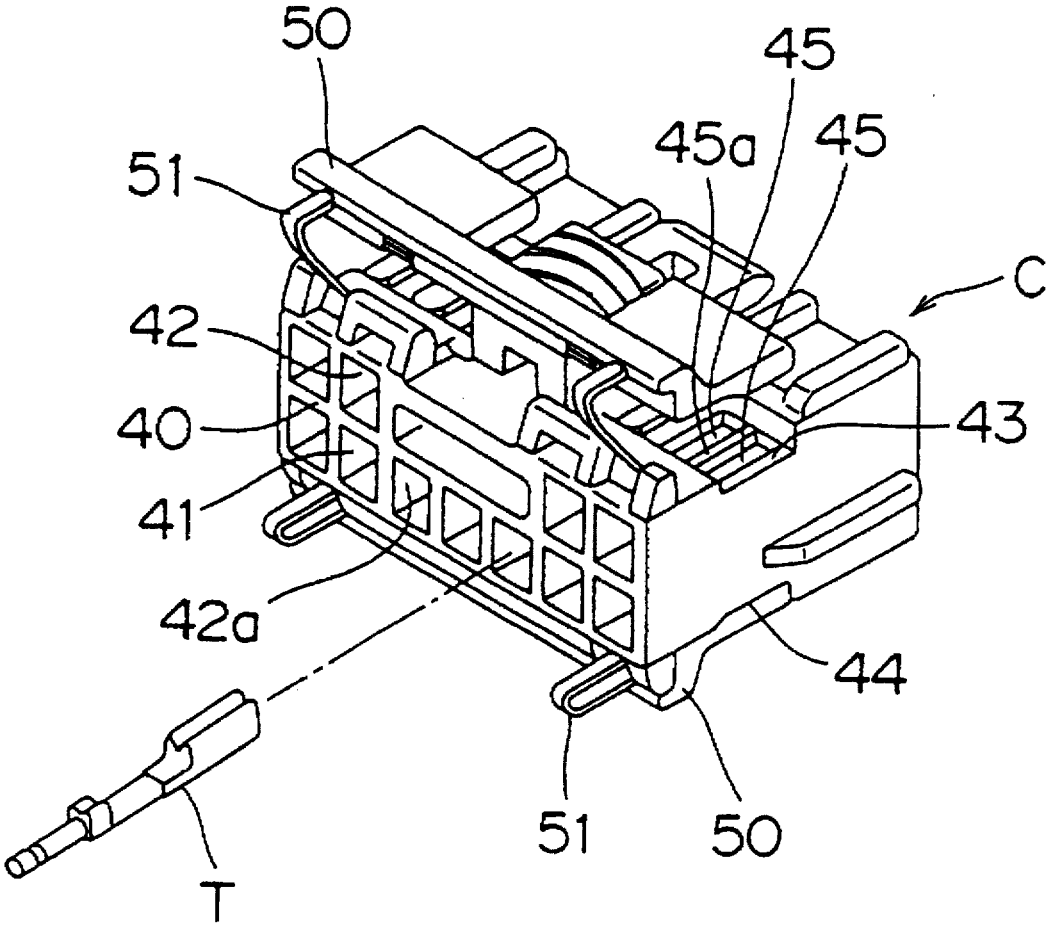
FIG. 2 is a perspective view illustrating the connector.

FIG. 2 is a perspective view illustrating the connector C.

Referring to FIG. 2, the connector C has a plurality of terminal insertion openings 41 formed on the rear end face 40 thereof and a plurality of terminal chambers 42 communicating with the terminal openings 41 for accommodating terminals T. The terminal chambers 42 are separated from each other by partition walls 42*a*, and each adapted to receive a single terminal T.

In this embodiment, it is assumed that terminals T are accommodated only in terminal chambers 42 at a lower position of the connector C. Therefore, the pivot member 20 is connected only to the lower support member 12 as shown in FIG. 1. Where terminals T are to be accommodated in terminal chambers 42 at upper and lower positions of the connector C, a pair of pivot members 20 are respectively connected to the upper and lower support members 11 and 12. In this case, the pair of pivot members 20 are disposed as facing to each other.

A reference numeral 50 denotes retainers. The retainers 50 serve to prevent the terminal T accommodated in the terminal chamber 42 from being withdrawn from the connector C. The retainers 50 are respectively connected to an upper face 43 and a lower face 44 of the connector C via connection bands 51. The retainers 50 each have a plurality of engagement projections not shown.

A plurality of retainer attachment openings 45 for attachment of the retainers 50 are formed in the upper face 43 and the lower face 44 of the connector C. The retainer attachment openings 45 each communicate with the corresponding terminal chamber 42. More specifically, when the retainers 50 are attached to the connector C from the outer sides thereof, the engagement projections of the retainers 50 are fitted through the retainer attachment openings 45 to engage with the respective terminals T accommodated in the terminal chambers 42, thereby preventing the withdrawal of the terminals T. It should be noted that FIG. 2 shows a state where the retainer 50 of the lower side is attached onto the lower face 44 of the connector C.

Figure 3:
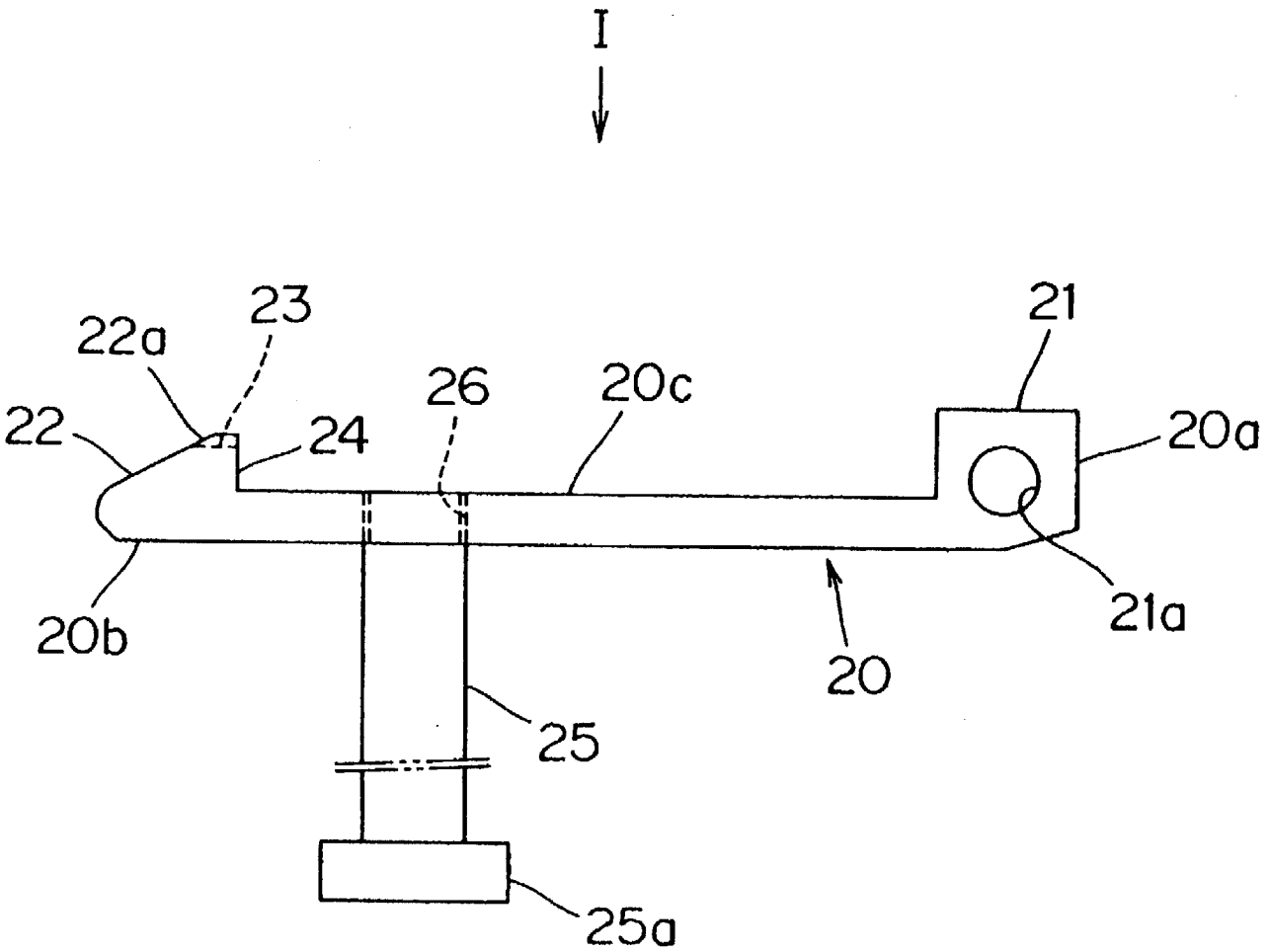
FIG. 3 is a side view illustrating a pivot member.
Figure 4:
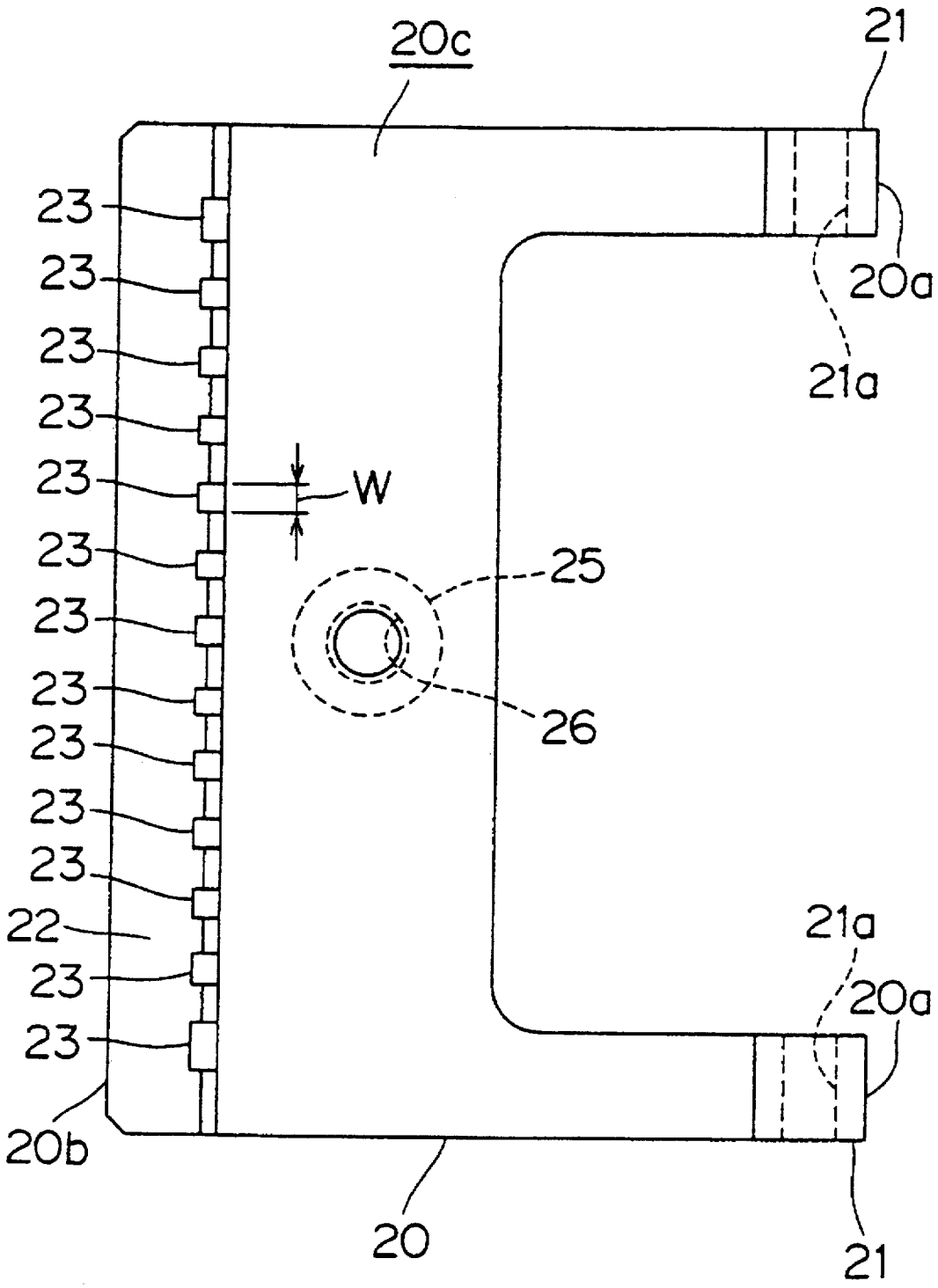
FIG. 4 is a plan view illustrating the pivot member.

FIG. 3 is a side view illustrating a pivot member 20, and FIG. 4 is a plan view of the pivot member as viewed from a side indicated by an arrow I in FIG. 3. Referring to FIGS. 1 to 3, the pivot member 20 will be described in detail.

As shown in FIG. 1, the pivot member 20 is supported pivotally around a shaft S by a support frame 15 projecting from the lower support member 12. More specifically, the pivot member 20 can assume either a first attitude which allows parts of the pivot member 20 to enter the retainer attachment openings 45 or a second attitude which allows the parts of the pivot member 20 to be retracted from the retainer attachment openings 45 (see FIG. 5) in a state where the connector C is held in the connector holding portion 14.

The pivot member 20 has an indented thin portion 20*c* formed besides proximal end portions 20*a* and a distal end portion 20*b* thereof. The proximal end portions 20*a* of the pivot member 20 are formed with a pair of bosses 21 respectively. The shaft S is inserted into openings 21*a* respectively formed in the bosses 21, and a center axis of the shaft S serves as a pivot axis of the pivot member 20. The pivot member 20 has a pair of proximal end portions 20*a* as shown in the plan view of the pivot member 20 of FIG. 4. The distal end portion 20*b* of the pivot member 20 is tapered (see FIG. 3). The distal end portion 20*b* has an inclined face 22 which rises from the edge thereof to the rear side, and an abutting face 24 which is to abut against peripheral portions of the retainer attachment openings 45 when the distal end portion 20*b* is engaged with the retainer attachment openings 45.

A plurality of through-grooves 23 are formed along a ridge of the tapered portion, i.e., in a portion 22*a* defined by the inclined face 22 and the abutting face 24. The through-grooves 23 extend across the portion 22*a* from the inclined face 22 to the abutting face 24. The through-grooves 23 are aligned across the width of the pivot member 20 (see FIG. 4). The pitch between two adjacent through-grooves 23 corresponds to the pitch between two adjacent partition walls 45*a* separating the retainer attachment openings 45 (see FIG. 2). The width W of each through-groove 23 corresponds to the thickness of each partition wall 45*a*. Therefore, when the pivot member 20 assumes the first attitude, the partition walls 45*a* respectively fit in the corresponding through-grooves 23. As a result, portions of the inclined face 22 are respectively engaged with the retainer attachment openings 45 in such a manner that the engagement depth gradually becomes greater along the terminal insertion direction.

A lever 25 for pivoting the pivot member 20 is attached to a generally middle portion of the pivot member 20. More specifically, a threaded hole 26 is formed in the generally middle portion of the pivot member 20, and a male screw portion is formed at an end of the lever 25. The lever 25 is threadedly attached to the pivot member 20 by screwing the male screw portion of the lever 25 into the threaded hole 26. A grip 25*a* is formed at a distal end of the lever 25 for easy hand gripping.

Referring to FIG. 1, the coil spring 30 is provided between the lower support member 12 and the pivot member 20. The coil spring 30 is fitted in the recess 12*a* of the lower support member 12, which serves as a seat for the coil spring 30. The lever 25 extends through the through-hole 12*b* of the lower support member 12 and the coil spring 30. Thus, the pivot member 20 is constantly urged resiliently toward the connector C by the coil spring 30.

The connector holding device A having a construction as described above operates as follows.

Referring to FIG. 1, the connector C is inserted into the connector holding portion 14 with the front end thereof facing opposite the connector holding portion 14. At this time, the front end of the connector C is moved in a sliding contact with the inclined face 22 in a direction indicated by a white arrow, while abutting against the pivot member 20 to depress the distal end portion 20*b* thereof. By continuously moving the connector C in this direction, the distal end portion 20*b* of the pivot member 20 is inserted between the lower face 44 of the connector C and the lower retainer 50. As the distal end portion 20*b* approaches the retainer attachment openings 45 of the connector C, the pivot member 20 biased by the coil spring 30 rotates toward the connector C. Thus, the partition walls 45*a* separating the retainer attachment openings 45 are respectively fitted into the corresponding through-grooves 23 of the pivot member 20, and the distal end portion 20*b* of the pivot member 20 enters the retainer attachment openings 45.

In this state, parts of the abutting face 24 of the pivot member 20 abut against parts of the peripheral surfaces 45*b* of the retainer attachment openings 45, and the pivot member 20 assumes the first attitude. Thus, the connector C is held as being appropriately positioned. The portions of the inclined face 22 are respectively engaged with the retainer attachment openings 45 of the connector C in such a manner that the engagement depth gradually becomes greater from the rear end 40 to the front end of the connector C.

In turn, the terminal T is inserted from the terminal insertion opening 41 (see FIG. 2) and accommodated in the terminal chamber 42.

If the terminal T is liable to direct outward and project from the retainer insertion opening 45 during the insertion of the terminal T, the terminal T abuts against the inclined face 22 of the pivot member 20. Therefore, the terminal T is moved along the inclined face 22 by forcibly inserting the terminal T into the terminal chamber 42. That is, the inclined face 22 corrects the insertion path of the terminal T, thereby allowing the terminal T to be inserted into the inner-most of the terminal chamber 42.

Figure 5:
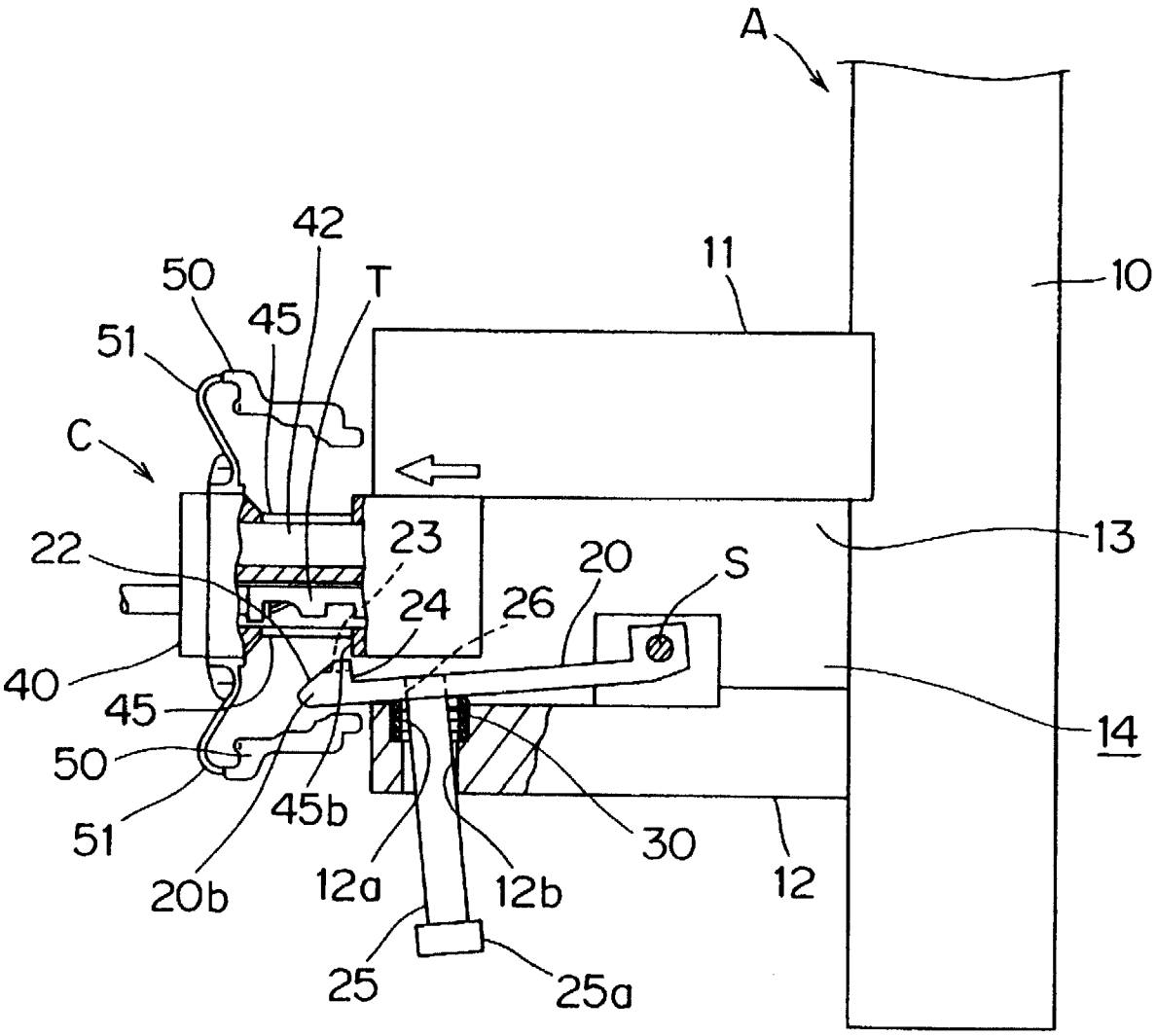
FIG. 5 is an enlarged partial side view in section illustrating the connector holding device in a state where the pivot member assumes a second attitude.

Upon completion of this terminal insertion process, the lever 25 is manually pulled in opposition to a resilient force of the coil spring 30. Thus, the pivot member 20 is pivoted about the shaft S to assume the second attitude as shown in FIG. 5. In this state, the connector C is pulled out of the connector holding portion 14. After the connector C is taken out, the retainer 50 is engaged with the retainer attachment openings 45 for prevention of the withdrawal of the terminal T.

In this embodiment, even if the terminal T is liable to direct outward and project from the retainer attachment opening 45 during the insertion of the terminal T, the inclined face 22 of the pivot member 20 corrects the insertion path of the terminal T. Therefore, the terminal T can be assuredly inserted into the inner-most of the terminal chamber 42 without projecting from the retainer attachment opening 45 or abutting against the peripheral surface 45*b* of the retainer attachment opening 45. Since the inclined face 22 formed on the pivot member 20 serves as means for correcting the insertion path of the terminal T, the construction of the connector holding device A can be simplified, thereby reducing the cost of the device.

The connector C can be readily taken out by pulling the lever 25 to release the connector C. The lever 25 may be manually pulled or, alternatively, pulled by means of an appropriate driving device such as an air cylinder connected to the lever 25. Such driving means allows for the automation of the process for attaching and detaching the connector C to/from the connector holding device A, thereby realizing a smooth and reliable terminal insertion process using an automated device.

Although the pivot member 20 is connected only to the lower support member 12 in this embodiment, another pivot member may be connected to the upper support member 11. In accordance with this embodiment, the connector C is held between the pivot member 20 and the upper support member 11. That is, the pivot member 20 does not only serve as the terminal insertion guide means but also as means for holding the connector C. Alternatively, the pivot member 20 may be engaged with the connector C which is supported by the upper support member 11, lower support member 12 and side support members 13 for the positioning thereof.

Instead of the pivot member 20, means for inserting a plate member between a retainer 50 and the upper face 43 or lower face 44 of the connector C is employed as means for correcting the insertion path of the terminal T. More specifically, the plate member is adapted to be moved across the width of the pivot member 20 (in a direction perpendicular to the plane of the FIG. 1) by means of an air cylinder, for example. The plate member is inserted between the retainer 50 and the upper face 43 or lower face 44 of the connector C with the connector C being held in the connector holding portion 14. This prevents the inserted terminal T from projecting from the retainer attachment opening 45, thereby allowing the terminal T to be assuredly accommodated in the terminal chamber 42. Needless to say, the plate member may be formed with an inclined face 22 as described above.

What is claimed is:

1. A connector holding device for holding a connector having a rear face, an upper face, a lower face, a terminal insertion opening formed on the rear face, and a retainer attachment opening formed on at least one of the upper face and the lower face thereof for attachment of a retainer for preventing terminal withdrawal, the connector holding device comprising:

a base;

an upper support member projecting from the base;

a lower support member projecting from the base;

a pair of side support members connecting the upper and lower support members, the upper support member, the lower support member and the side support members defining a connector holding space; and terminal insertion guide means provided in association with the connector holding space and facing the retainer attachment opening when a connector is held by the connector holding device.

2. A connector holding device as set forth in claim 1, wherein the terminal insertion guide means includes a pivot member pivotally connected with the upper support member or the lower support member.

3. A connector holding device as set forth in claim 2, wherein the pivot member includes a guide face for guiding the terminal in a predetermined terminal insertion direction, the guide face being adapted to fit in the retainer attachment opening of the connector to prevent the terminal from advancing in an incorrect direction and projecting from the retainer attachment opening.

4. A connector holding device as set forth in claim 3, wherein the guide face includes an inclined face adapted to be engaged with the retainer attachment opening in such a manner that the depth of the engagement gradually becomes greater along the terminal insertion direction.

5. A connector holding device as set forth in claim 2, further comprising biasing means for constantly biasing the pivot member in a predetermined direction.

6. A connector holding device as set forth in claim 5, further comprising an operation lever for shifting the position of the pivot member in opposition to a biasing force of the biasing means.

7. A connector holding device as set forth in claim 1, wherein the upper support member, the lower support member, and the side support members define other connector holding spaces forming a plurality of connector holding spaces that are aligned along a predetermined direction at predetermined intervals; and wherein the terminal insertion guide means includes a single pivot member serving for the plurality of connector holding spaces, and a plurality of guide faces formed on the pivot member in correspondence to the respective connector holding spaces.

8. A connector holding device as set forth in claim 7, further comprising positioning means disposed in association with one of the connector holding spaces for positioning a connector held in the said one connector holding space.

9. A connector holding device as set forth in claim 8, wherein the positioning means is provided in the terminal insertion guide means.

10. A connector holding device as set forth in claim 9, wherein the positioning means includes an abutting face adapted to abut against the retainer attachment opening of the connector.

* * * * *